US011378350B1

(12) United States Patent
Kempf et al.

(10) Patent No.: US 11,378,350 B1
(45) Date of Patent: Jul. 5, 2022

(54) PROJECTILE LAUNCHING DEVICE WITH SELF-TIMING AND WITHOUT CAM LEAN

(71) Applicant: Archery Innovators, Tiffin, IA (US)

(72) Inventors: James J. Kempf, Coralville, IA (US); Rex E. Isenhower, Mount Pleasant, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 17/240,283

(22) Filed: Apr. 26, 2021

Related U.S. Application Data

(63) Continuation-in-part of application No. 16/793,127, filed on Feb. 18, 2020, now Pat. No. 11,022,398.

(60) Provisional application No. 62/864,056, filed on Jun. 20, 2019.

(51) Int. Cl.
*F41B 5/12* (2006.01)
*F41B 5/10* (2006.01)

(52) U.S. Cl.
CPC ..... *F41B 5/123* (2013.01); *F41B 5/105* (2013.01)

(58) Field of Classification Search
CPC .... F41B 5/10; F41B 5/105; F41B 5/12; F41B 5/123
USPC ..... 124/25, 25.6, 900
See application file for complete search history.

(56) References Cited

U.S. PATENT DOCUMENTS 4,457,288 A * 7/1984 Ricord ..... F41B 5/10 124/900
4,649,891 A * 3/1987 Bozek ..... F41B 5/123 124/25
5,678,528 A * 10/1997 Hadley ..... F41B 5/12 124/25.5
6,776,148 B1 * 8/2004 Islas ..... F41B 5/105 124/25.6
6,792,931 B1 * 9/2004 Schaar ..... F41B 5/10 124/25.6
7,578,289 B2 * 8/2009 Norkus ..... F41B 5/10 124/44.5
7,637,256 B2 * 12/2009 Lee ..... F41B 5/10 124/25.6
7,823,572 B2 * 11/2010 Anderson ..... F41B 5/1469 124/25
8,037,876 B1 * 10/2011 Yehle ..... F41B 5/10 124/25.6
8,387,603 B2 * 3/2013 Darlington ..... F41B 5/105 124/25
8,651,095 B2 * 2/2014 Islas ..... F41B 5/123 124/900
8,826,894 B1 * 9/2014 Darlington ..... F41B 5/105 124/900

(Continued)

*Primary Examiner* — Alexander R Niconovich
(74) *Attorney, Agent, or Firm* — Donald J. Ersler

(57) ABSTRACT

A projectile launching device includes self-timing without cam lean. The projectile launching device preferably includes a rail, a riser, two energy storing components, (such as two limbs), two cams, a launch string, and at least two cables. The ends of the launch string are attached to the two cams. Opposing ends of first and second cables are coupled to the first and second cams. A mid-segment of the first and second cables are slidably engaged with the first and second cable pulleys, respectively. The two cams are preferably built as mirror images of each other at a centerline of the rail. The two cams include a launch string track, having identical, but mirrored, upper and lower cable tracks.

15 Claims, 16 Drawing Sheets

(56) References Cited

U.S. PATENT DOCUMENTS

| | | | | |
|---|---|---|---|---|
| 9,234,719 | B1 * | 1/2016 | Kempf | F41B 5/12 |
| 9,243,861 | B1 * | 1/2016 | Kempf | F41B 5/12 |
| 9,377,267 | B1 * | 6/2016 | Kempf | F41B 5/105 |
| 9,453,698 | B1 * | 9/2016 | Grace | F41B 5/1411 |
| 9,494,379 | B2 * | 11/2016 | Yehle | F41B 5/10 |
| 9,513,080 | B1 * | 12/2016 | Kempf | F41B 5/1411 |
| 9,759,509 | B1 * | 9/2017 | Kempf | F41B 5/123 |
| 9,829,268 | B1 * | 11/2017 | Kempf | F41B 5/105 |
| 9,879,938 | B1 * | 1/2018 | Isenhower | F41B 5/123 |
| 10,048,036 | B1 * | 8/2018 | Kempf | F41B 5/105 |
| 10,267,592 | B2 * | 4/2019 | Bartels | F41B 5/123 |
| 10,386,151 | B2 * | 8/2019 | McPherson | F41B 5/123 |
| 10,393,470 | B1 * | 8/2019 | Popov | F41B 5/105 |
| 10,458,742 | B1 * | 10/2019 | Kempf | F41B 5/123 |
| 10,473,418 | B2 * | 11/2019 | Shaffer | F41B 5/123 |
| 10,495,404 | B2 * | 12/2019 | Shaffer | F41B 5/1469 |
| 10,514,226 | B2 * | 12/2019 | Shaffer | F41B 5/105 |
| 10,989,492 | B1 * | 4/2021 | Kempf | F41B 5/105 |
| 11,022,398 | B1 * | 6/2021 | Kempf | F41B 5/105 |
| 11,112,205 | B1 * | 9/2021 | Kempf | F41B 5/123 |

* cited by examiner

PROJECTILE LAUNCHING DEVICE WITH SELF-TIMING AND WITHOUT CAM LEAN

CROSS-REFERENCES TO RELATED APPLICATIONS

This is a continuation patent application, which claims priority from patent application Ser. No. 16/793,127, filed on Feb. 18, 2020, which claims the benefit of provisional patent application No. 62/864,056, filed on Jun. 20, 2019. The above patent applications are hereby incorporated by reference in their entireties.

BACKGROUND OF THE INVENTION

Field of the Invention

The present invention relates generally to archery and more specifically to a shooting bow with a unique cable arrangement, which allows a portion of first and/or second cables to be slidably engaged to a first and second pulley, and the ends of each cable are anchored to the same cam. This arrangement enables the device to have self-timing. The present invention may alternately use components other than flexible limbs for storing energy prior to launching the projectile.

Discussion of the Prior Art

Historically, archery bows and crossbows have been used for war, survival, sport, and recreation. A specific component of a compound style shooting bow are the cables. Typically, each cable includes a power end and a control end. The manner in which the cables interact with the cams and limbs of the bow is of particular importance. Typically, the power end of the cable is coupled to the cam on one limb, and the control end of the cable is often coupled to the opposite limb or opposite cam. A very good way to accomplish efficiency is through a binary cam system, wherein the cables are connected to opposing cams, and as one of the cams wraps the cable on the power track, the opposite cam pays out cable from the control track. While all of these methods work to some extent, all have significant issues with performance related to cam lean, and/or assembly and cost. Due to the crossing of cables and the need to keep the cables from interfering with the flight of the arrow, the cables often are off-angle, which in turn creates twisting and torque in a cam axle, thus creating cam lean.

U.S. Pat. No. 4,457,288 to Ricord discloses a cam lever compound bow, where a bow utilizes single string wrapping pulleys journaled to the ends of the bow limbs, and the ends of the string are coupled to a cam device mounted upon the bow riser. Although, this method does remove the problem of the cables being in the way, it is very inefficient, and timing issues from one limb to the other is a factor. U.S. Pat. No. 7,637,256 to Lee discloses a compound bow, which provides a shooting bow that removes the issue of cables interfering with the flight of the arrow. However, the inefficient use of tensioning devices severely limits the potential of this device. U.S. Pat. No. 8,651,095 to Islas discloses a bowstring cam arrangement for compound crossbow, which provides a method of removing the cables from the path of the string. U.S. Pat. No. 9,494,379 to Yehle discloses a crossbow, where Yehle relies on four cables. Issues are created by having separate cables above and below the string track on each cam. If the cables are not of exact length, or if the upper cable stretches more than the lower cable, or visa-versa, the cables must be adjusted by the user to stay in time with each other. Timing of the cables can be a time consuming and a very difficult process. U.S. Pat. No. 9,759,509 to Kempf teaches a cable configuration wherein the cables are anchored to the cams, which allows for self-timing. More recently, Hoyt introduced a cable configuration wherein the ends of the cable are anchored to the cam, and a central portion of the cable passes through a sleeve. This system is beneficial, however still lacks the smooth passage of the cables to self-time, further there is no provision for the cams to rotate more than about 180 degrees. The present invention deals with the manner in which the cables are coupled to the cams of the bow or crossbow.

Accordingly, there is a clearly felt need in the art to provide a shooting bow, which allows a mid-portion of first and second cables to be slidably engaged on a first and second pulley, and the ends of the cables are coupled to the same cam, respectively, wherein the cam is allowed to rotate at least 200 degrees, up to at least 360 degrees. Historically with all prior art, cams that rotate more than 200 degrees up to about 300 degrees do not require the use of a wider cable track, as the cables are not required to stack upon themselves. The cables do not cross the centerline of the shooting bow. Additionally, the cams are allowed to rotate 360 degrees due to a wider upper and lower cable track, or alternately a divided helical cable track, which allows the cable to wrap adjacent to itself.

SUMMARY OF THE INVENTION

The present invention provides a self-timing cam and cable configuration for a projectile launching device. The present invention includes a pair of cables, wherein both ends of the same cable anchors to the same cam(s), and also reduces or eliminates cam lean. The projectile launching device with self-timing and without cam lean (projectile launch device) may be applied to either a crossbow or vertical bow. The projectile launch device preferably includes a first cam, a second cam, a launch string and two cables, collectively known as a harness system. This configuration allows opposing ends of a first cable to be anchored to a first cam, and opposing end of a second cable to be anchored to a second cam. Preferably, the first and second cables do not cross a centerline of the shooting bow. In a second preferred embodiment, the projectile launching device preferably includes a string latch housing, a bow riser, a rail, a first energy storing device (such as a first limb), a second energy storing device (such as a second limb), a first cam, a second cam, at least one bowstring, and two cables.

The term "limb" may refer to what are known as solid limbs, split-limbs, tube-limbs, or any other flexible energy storing component. The bow riser is enjoined with the rail. One end of the first limb extends from a first end of the bow riser and one end of the second limb extends from a second end of the bow riser. The first cam is pivotally retained on the first limb and the second cam is pivotally retained on the second limb. A first end of the launch string is retained by the first cam and a second end of the launch string is retained by the second cam. On an alternative embodiment, a first set of first and second cable posts are located on a first side of a centerline of the rail and a second set of first and second cable posts are located on a second side of the centerline of the rail. These cable posts may be used to anchor a secondary set of cables which support the cable pulleys. The first cam includes a first cam launch string track, an upper first cam cable track, located above the launch string track, and a lower first cam cable track, located below the launch string track. The second cam includes a second cam launch string track, an upper second cam cable track, located above the launch string track, and a lower second cam cable track, located below the launch string track. The first set of first and second cable posts are located above the plane of the launch string, and the second set of first and second cable posts are located below the plane of the launch string.

A first end of the first cable is coupled to the first cam first cable post; a segment of the first cable before a middle of the first cable partially engages the first cable pulley; the middle of the first cable partially wraps the first cable track; a segment of the first cable after the middle of the first cable partially engages the first cam second cable track; and a second end of the first cable is coupled to the first cable second cable post. A first end of the second cable is coupled to the second cam first cable post; a segment of the second cable before a middle of the second cable partially engages the second cam first cable track; the middle of the second cable partially wraps the second cable pulley; a segment of the second cable after the middle of the second cable partially engages the second cam second cable track; and a second end of the second cable is coupled to the second cable second cable post.

When the launch string is drawn from a rest position to a ready to fire position, the first cam rotates in a first direction and the second cam rotates in a second direction. As the first and second cams rotate, the launch string is unwound from the first and second launch string tracks. Simultaneously, the first and second cables wind into the first and second cable tracks of the first and second cams.

A unique feature of the present invention is that both ends of the first and second cables are firmly fixed to the same cam, and the middle portions "float" or slide relative to the first and second cable pulleys. The first and second cables are of one piece, and as the cable stretches, it self-centers itself about the cable pulleys. The term "pulley" is used as a general term for a component or feature engaging the cables to allow for the smooth transition of a segment of the cables from above the bowstring to below the bowstring, from a first side of the cams to a second side of the cams, wherein the component or feature (the cable retention transition) is coupled with the frame, structure, support, barrel, or riser, providing a slidable retention position for the segment of the cables. The cable retention transition preferably has a curved shape, which the cable makes contact with, but other shapes may also be used.

Another unique feature of the present invention is the ability of the cam to rotate a full 360 degrees, such that as the cams are rotating, the upper and lower cable portions wrap the cable cams.

In a preferred embodiment, the launch string may be releasably retained in the ready-to-fire position by mechanisms known as a string latch assembly or a string release.

In a first preferred alternative embodiment, the launch string may be held in the ready-to-fire position and released by the users' fingers.

In a second preferred alternative embodiment, a rail-less crossbow design may be used.

In a third preferred alternative embodiment, the same harness system configuration may be used on projectile launching devices utilizing energy storing components other than flexible limbs. These other types of energy storing components include spring(s), hydraulics, or pressurized cylinder(s).

For clarity, the word coupled is being defined as a way to connect an object, such as a bowstring or cable, with another object, be it directly or indirectly, such as directly to a post or pulley, or indirectly as in from the end of a string or cable, to an intermediate object, and then to a limb or axle.

Though the term "pulley" has been used through out the application, "pulley" references the component used to slidably retain and transition the cables from a first side of the bowstring track to a second side of the bowstring track, any component fulfilling the same function may be utilized and may or may not be known as a pulley in the traditional sense, and may or may not function as a rotate-able pulley, as rotation of the component is not a prerequisite to retention and transition of said the cables.

The term "rail" is used as a general term describing an elongated component that directly or indirectly supports the front of an arrow. "Rail-less" crossbows still have an elongated component that is coupled with a riser or other structure, wherein the elongated component directly or indirectly supports the front of an arrow.

The term "slidably" as used in the application as to reference how a segment of the cables engage the cable "pulleys", in that the mid-segment of the cable is retained by, and not fixed to, the "pulley". The first and second ends of the cables are anchored in a fixed position relative to each other, preventing the mid-segment of the cables from actually moving back and forth, or sliding.

Accordingly, there is a clearly felt need in the art for a projectile launching device with no cam lean, having a first cam, a second cam, a launch string and at least two cables, collectively known as a harness system, where both ends of the same cable are rigidly attached to the same cam, and the mid-portion of each cable at least partially wraps a cable pulley.

Further, there is a clearly felt need in the art to provide a shooting bow, which allows a mid-portion of first and second cables to be slidably engaged on a first and second pulley, and the ends of the cables are coupled to the same cam, respectively, wherein the cam is allowed to rotate at least 200 degrees up to about 300 degrees, and up to at least 360 degrees. Historically with all prior art, cams that rotate more than 200 degrees up to about 300 degrees do not require the use of a wider cable track, as the cables are not required to stack upon themselves. The cables do not cross the centerline of the shooting bow.

Finally, the cams may be allowed to rotate up to 360 degrees due to a wider upper and lower cable track, or alternately a divided helical cable track, which allows the cable to wrap adjacent to itself.

These and additional objects, advantages, features and benefits of the present invention will become apparent from the following specification.

DETAILED DESCRIPTION OF THE PREFERRED EMBODIMENTS

Figure 1A:
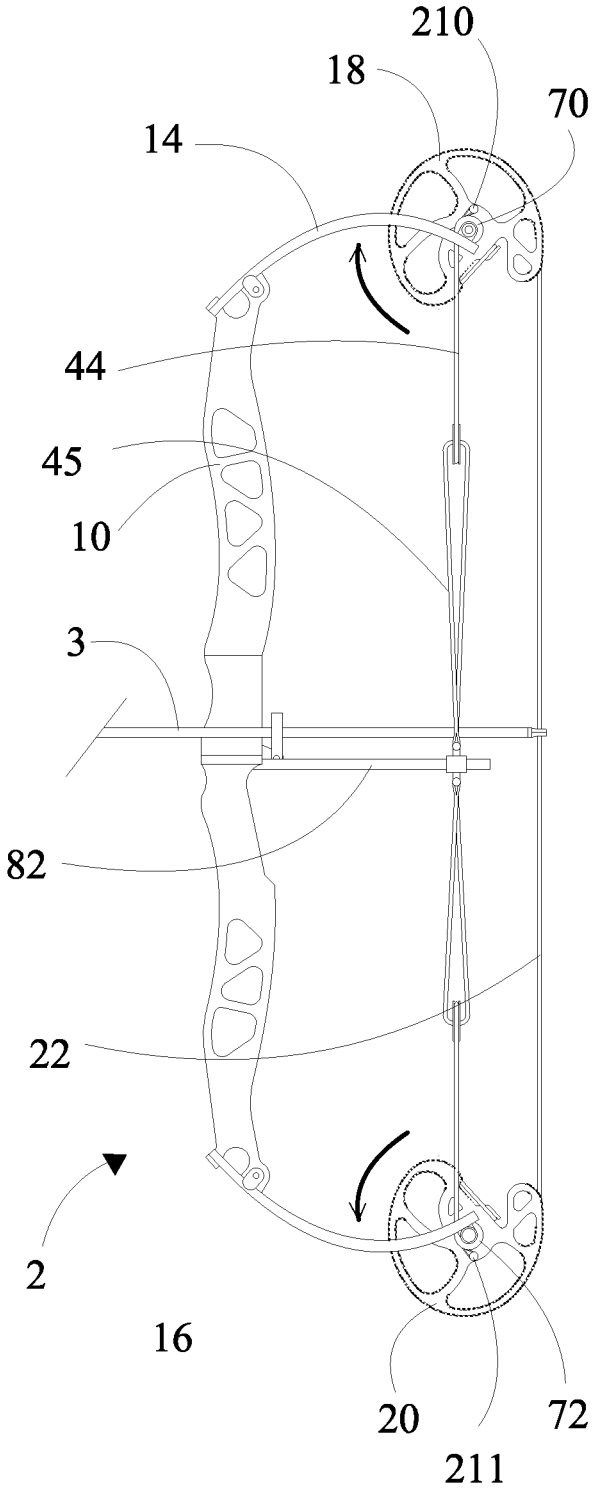
FIG. 1A is a partial rear view of a vertical bow of the present invention, having a first and second cam, a first and second cable, and a string, wherein opposing ends of the same cable are anchored to the same cam, and a mid-portion of the cables partially wrap a cable pulley of the present invention.
Figure 1B:
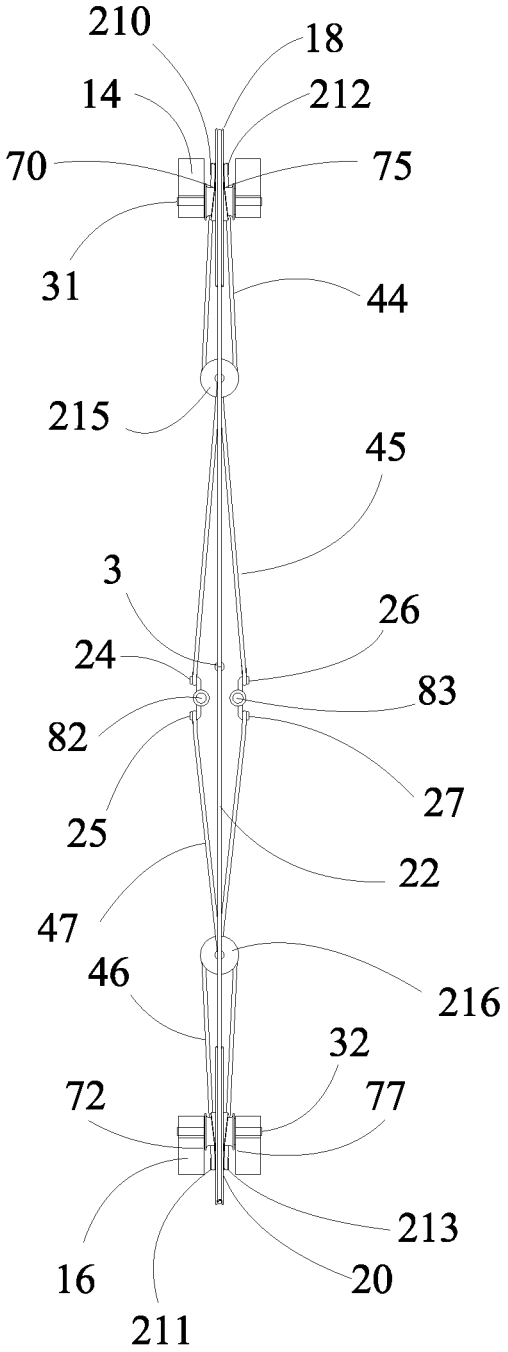
FIG. 1B is a partial rear view of a vertical bow of the present invention, having a first and second cam, a cable, and a string, wherein opposing ends of the same cable are anchored to the same cam, and a mid-portion of the cables partially wrap a cable pulley of the present invention.

With reference now to the drawings, FIGS. 1, 1A and 1B show views of a vertical bow-type projectile launching device 2. The projectile launching device 2 preferably includes a bow riser 10, a first limb 14, a second limb 16, a first cam 18, a second cam 20 and a launch string 22. One end of the first limb 14 is attached to a first end of the bow riser 10 and one end of the second limb 16 is attached to a second end of the bow riser 10. The first cam 18 is pivotally retained on an opposing end of the first limb 14 with a first axle 31 and the second cam 20 is pivotally retained on an opposing end of the second limb 16 with a second axle 32.

With more specific reference to FIG. 1A, the disclosed embodiment illustrates a vertical bow 2 having a first cable 44 and a second cable 46, wherein a first end of the first cable 44 is anchored to a first cable first post 210, and a second end of the first cable 44 is anchored to a first cable second cable post 212. A first end of the second cable 46 is anchored to a second cable first cable post 211 and a second end of the second cable 46 is anchored to a second cable second post 213. A first cable spanner bar 82 is coupled to the riser 10 on a first side of the launch string 22, and a second cable spanner bar 83 is coupled to the riser 10 on a second side of the launch string 22. The cable spanner bars 82 and 83 displace the first and second pulley mounting cables 45 and 47 a distance away from the launch string 22 to allow clearance for an arrow 33.

More specifically referring to FIG. 1B, the disclosed embodiment illustrates a vertical bow 2. The first spanner bar 82 is coupled to the riser 10 on the first side of the launch string 22, and the second spanner bar 83 is coupled to the riser 10 on the second side of the launch string 22. A first end of a first cable 44 is coupled to a first cam 18 first cable anchor 210, a mid-segment of said first cable partially wraps a first cable pulley 215, and a second end of said first cable anchors to a first cam 18 second cable post 212. A first end of a second cable 46 is coupled to a second cam 20 first cable anchor 211, a mid-segment of said second cable 46 partially wraps a second cable pulley 216, and a second end of said second cable 46 anchors to a second cam 18 second cable post 213. The first cable pulley 215 is coupled to a first pulley mounting cable 45 and first and second first pulley mounting cable post 24 and 26. The second cable pulley 216 is coupled to a second pulley or transition mounting cable 47 and first and second second-pulley mounting cable post 25 and 27.

Figure 2A:
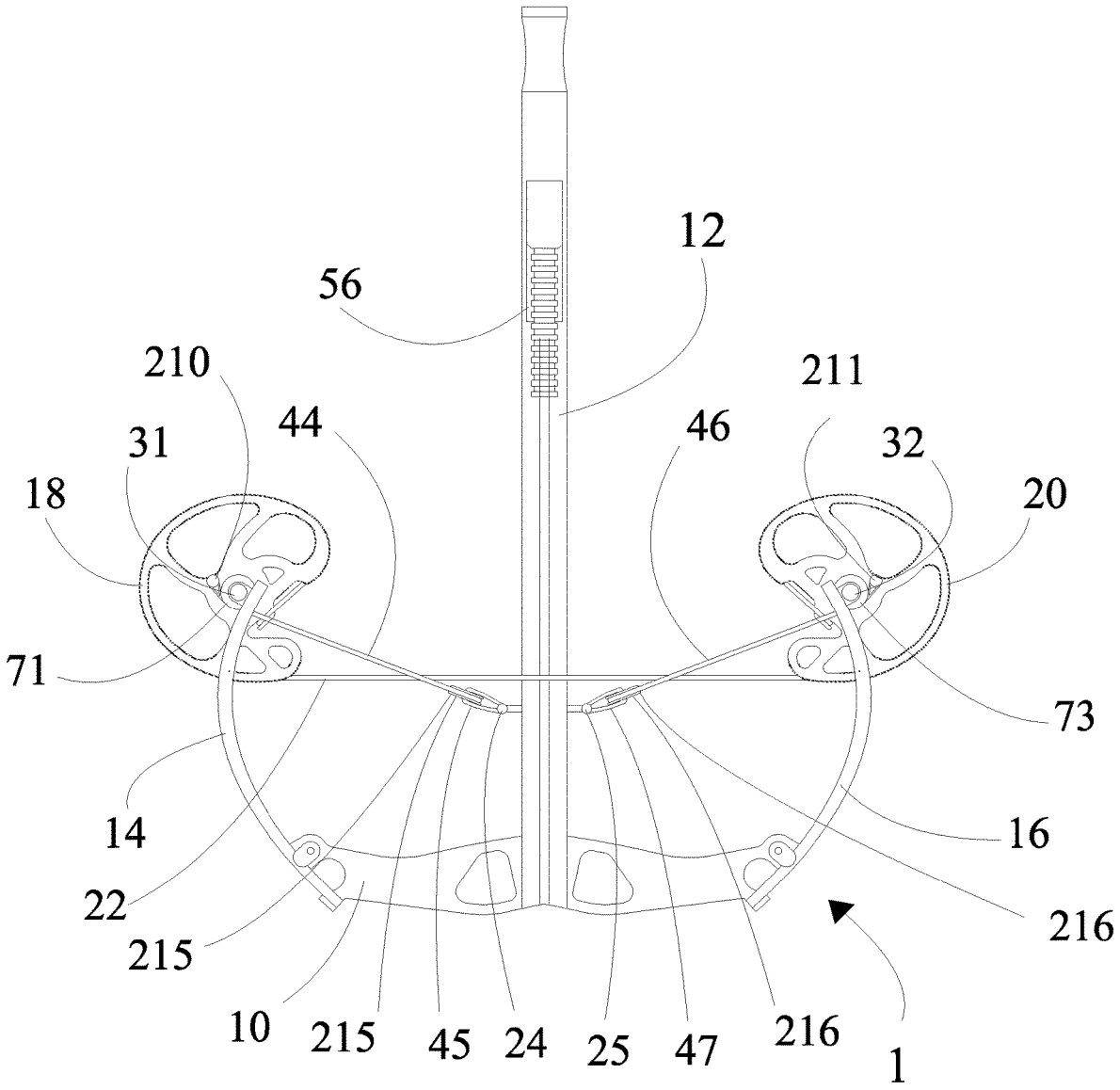
FIG. 2A is a top view of a conventional limb crossbow with inverted cams of the present invention in an at-rest position, having first and second cams; first and second cables; and a string, wherein opposing ends of the same cable are anchored to the same cam, and a mid-portion of the cables partially wrap a cable pulley of the present invention.
Figure 2B:
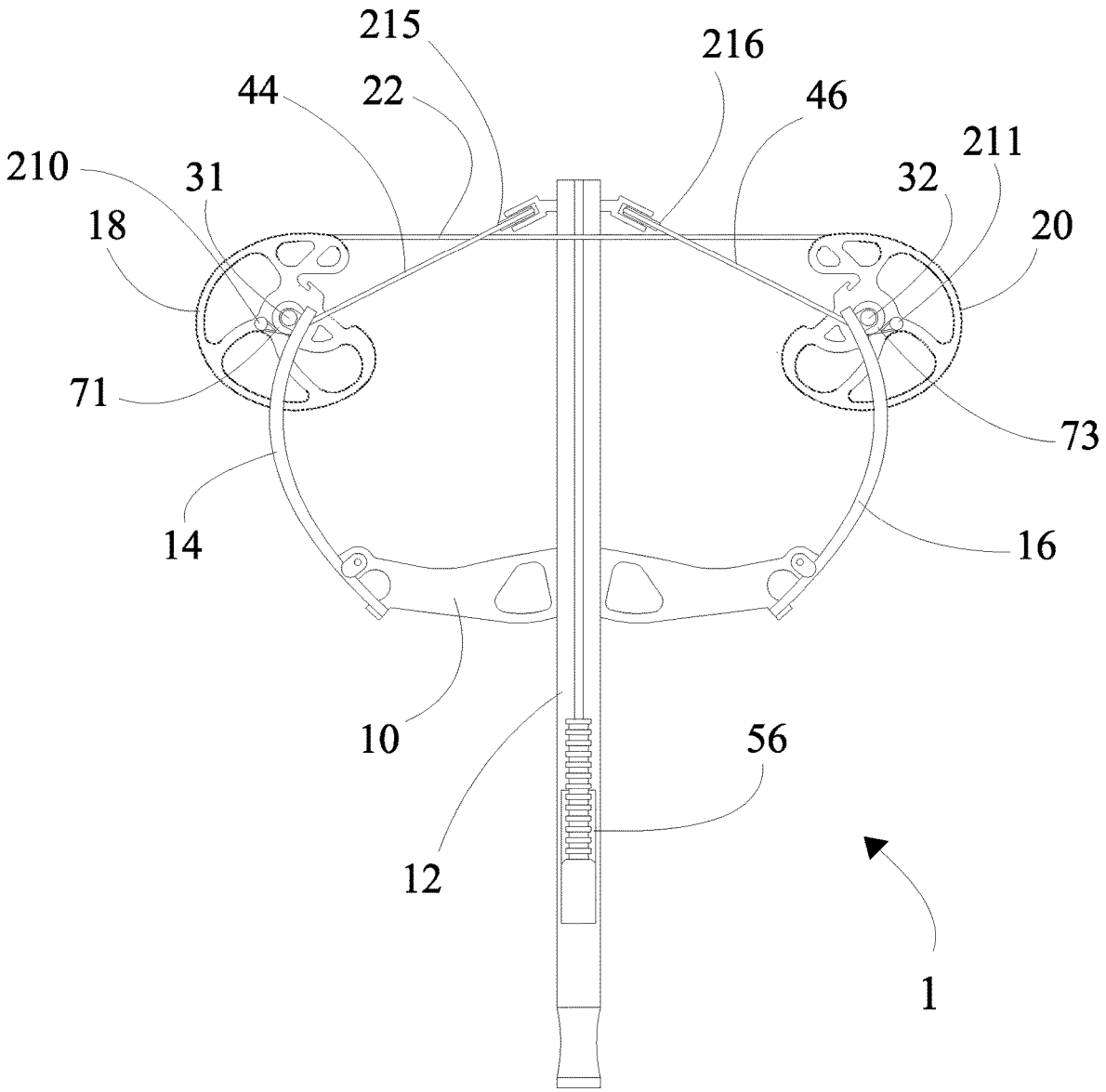
FIG. 2B is a top view of a reverse draw crossbow of the present invention in an at-rest position, having first and second cams; first and second cables; and a string, wherein opposing ends of the same cable are anchored to the same cam, and a mid-portion of the cables partially wrap a cable pulley—of the present invention.

FIGS. 2A and 2B illustrate a crossbow 1 of the current invention. The bow riser 10 may be joined with the rail 12 in any method known to join two pieces, as well as the rail 12 and the riser 10 being formed together as a single unit. The projectile launching device 1 preferably includes the riser 10, the rail 12, a first limb 14, a second limb 16, a first cam 18, a second cam 20 and a launch string 22.

A first end of the first limb 14 is coupled to a first end of the bow riser 10 and a first end of the second limb 16 is coupled to a second end of the bow riser 10. The first cam 18 is pivotally retained on an opposing end of the first limb 14 and the second cam 20 is pivotally retained on an opposing end of the second limb 16. The crossbow 1 includes a first cable 44 and a second cable 46. With reference to FIGS. 2A and 2B, the first end of the first cable 44 is anchored to the first cable first post 210, and the second end of the first cable 44 is anchored to the first cam second cable post 212. The first end of the second cable 46 is anchored to the second cable first cable post 211, and the second end of the second cable 46 is anchored to the second cable second post 213.

The first end of the first pulley mounting cable 45 is coupled to a first cable pulley or the first cable retention transition 215 and a first pulley mounting cable first and second post 24 and 26 (26 not shown). The first end of the second pulley mounting cable 47 is coupled to a second cable pulley or the second cable retention transition 216 and a second pulley mounting cable first and second post 25 and 27 (27 not shown).

Figure 2C:
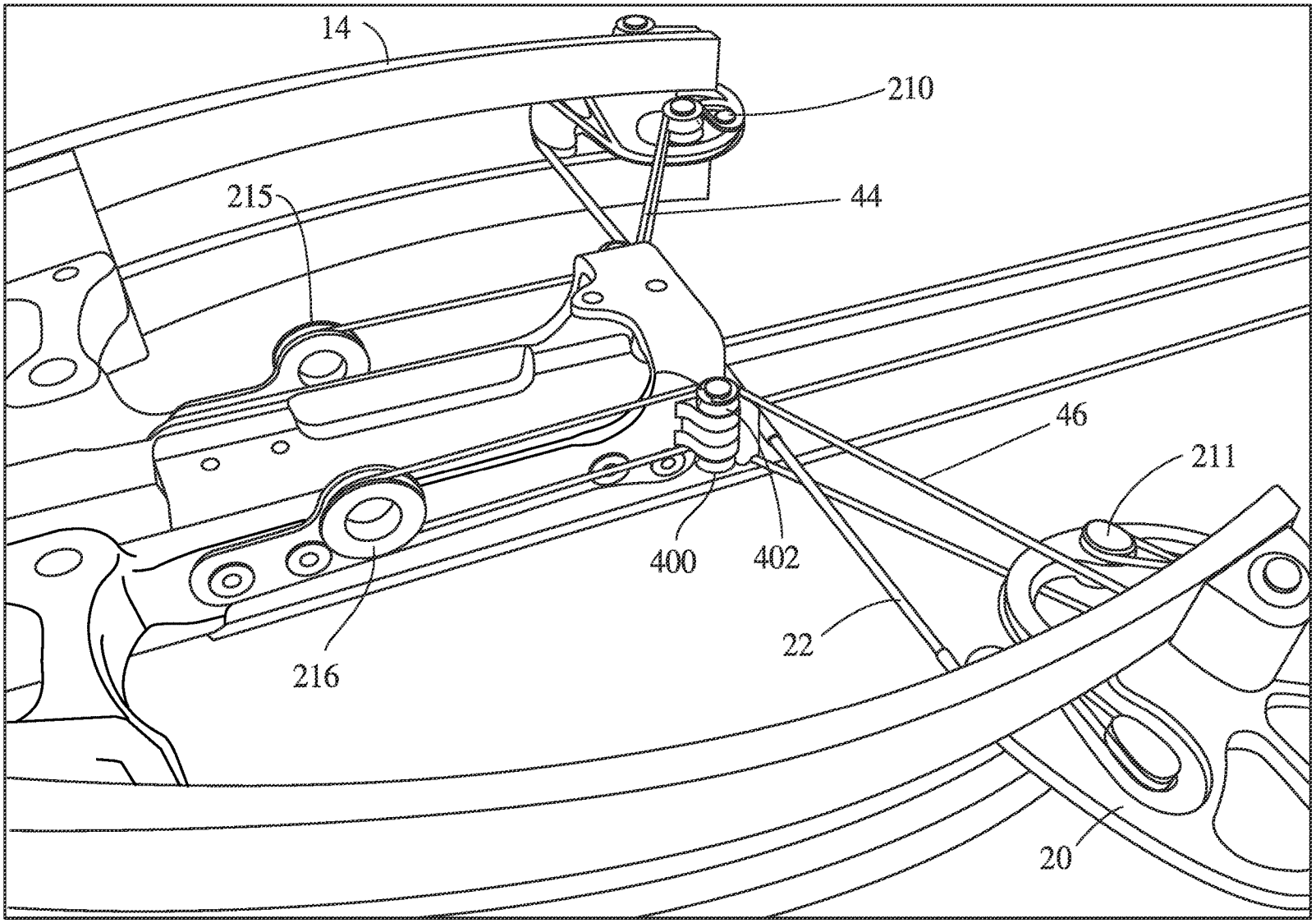
FIG. 2C is a perspective view of a crossbow with the string at rest where each end of a first cable is anchored to a first cam, each end of a second cable is anchored to a second cam, and first and second directional transition components are located between the cams and the cable pulley of the present invention.
Figure 2D:
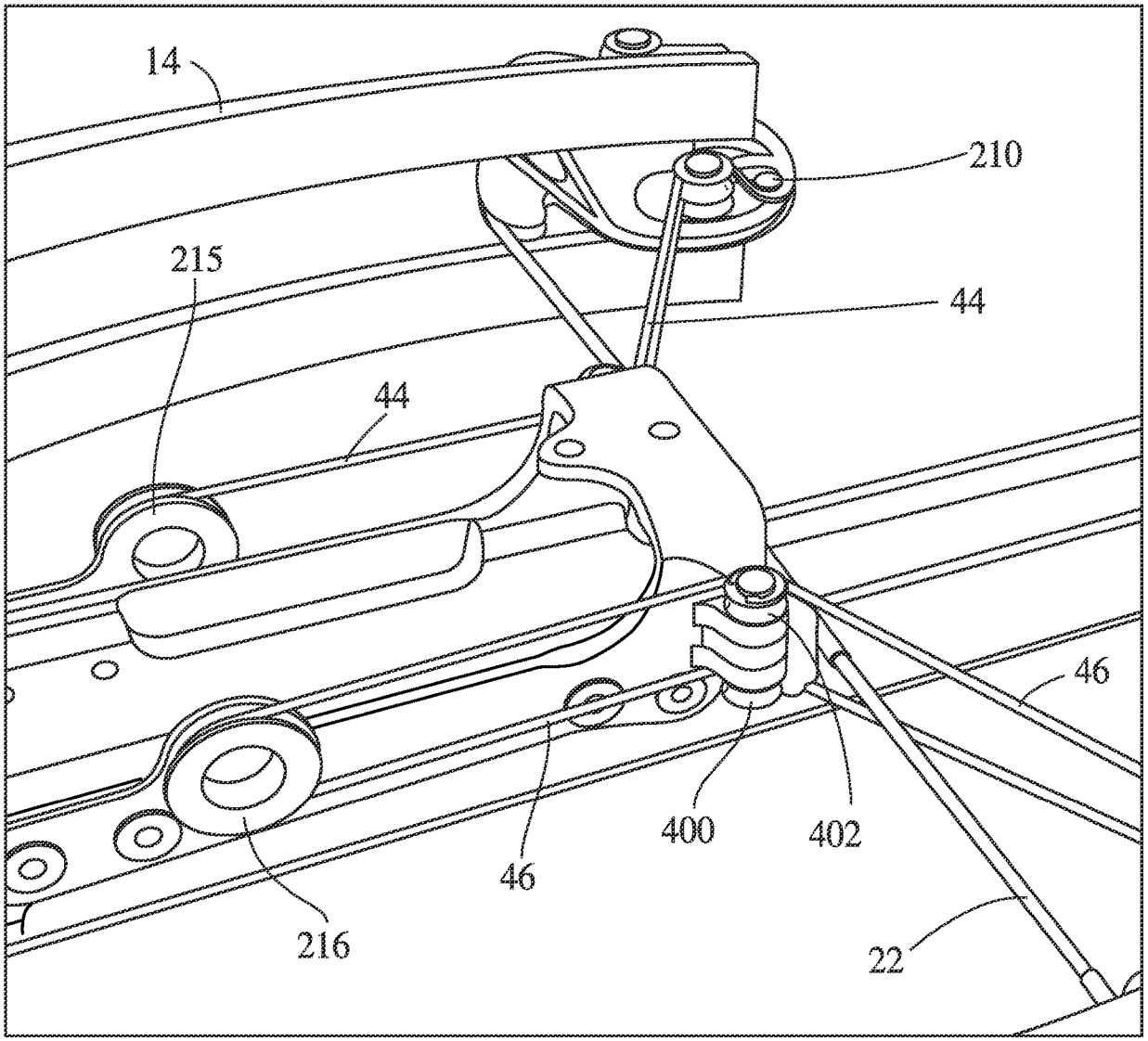
FIG. 2D is a first close up view of FIG. 2C of the present invention.
Figure 2E:
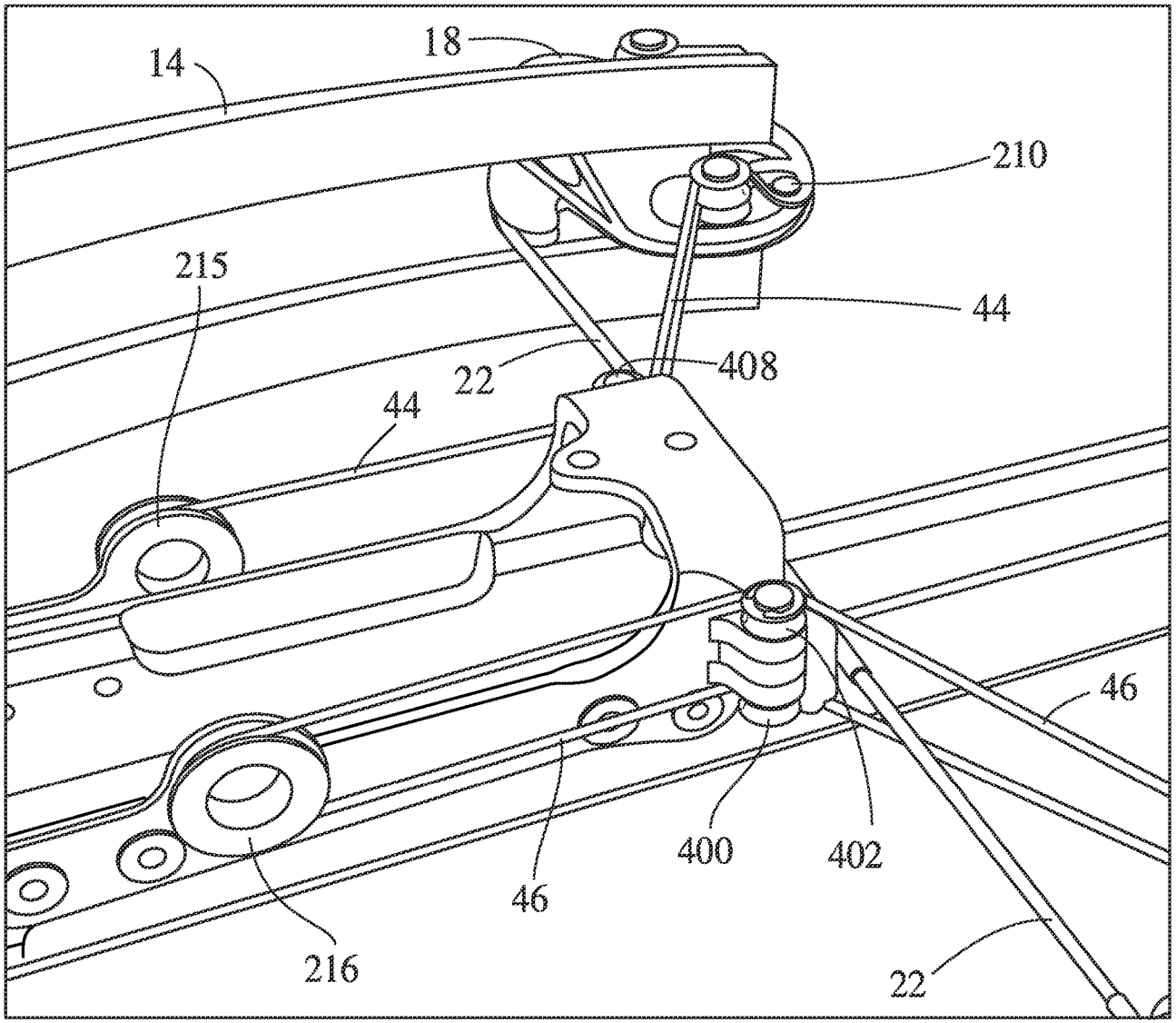
FIG. 2E is a second close up view of FIG. 2C of the present invention.

FIGS. 2C-2E, disclose a first and a second cable 44 and 46, each cable having a first end and a second end; and a first and a second cam 18 and 20. The first end of the first cable 44 is anchored to the first cam 18 and engages a first cable track of the first cam 18; the first cable 44 then spans to a first directional transition 408, (A component that alters the direction of the span. The directional transition may be of any smooth-surface that retains the cable.) The first cable 44 then spans to and is retained by a first cable pulley 215, the first cable 44 then spans to a second directional transition (not shown), then spans to engage a second cable track of the first cam 44, and the second end of the first cable 44 is anchored to the first cam 18. The first end of the second cable 46 is anchored to the second cam 20 and engages a first cable track of the second cam 20; the second cable 46 then spans to a third directional transition 402, then spans to and is retained by a second cable pulley 216, the second cable 46 then spans to a fourth directional transition 400, then spans to engage a second cable track of the second cam 20, and the second end of the second cable 46 is anchored to the second cam 20. The first and second directional transitions are a mirror of the third and fourth directional transitions 400, 402. The use of directional transitions allows for flexibility in design, and management of structural forces that would be impossible without them.

Figure 3:
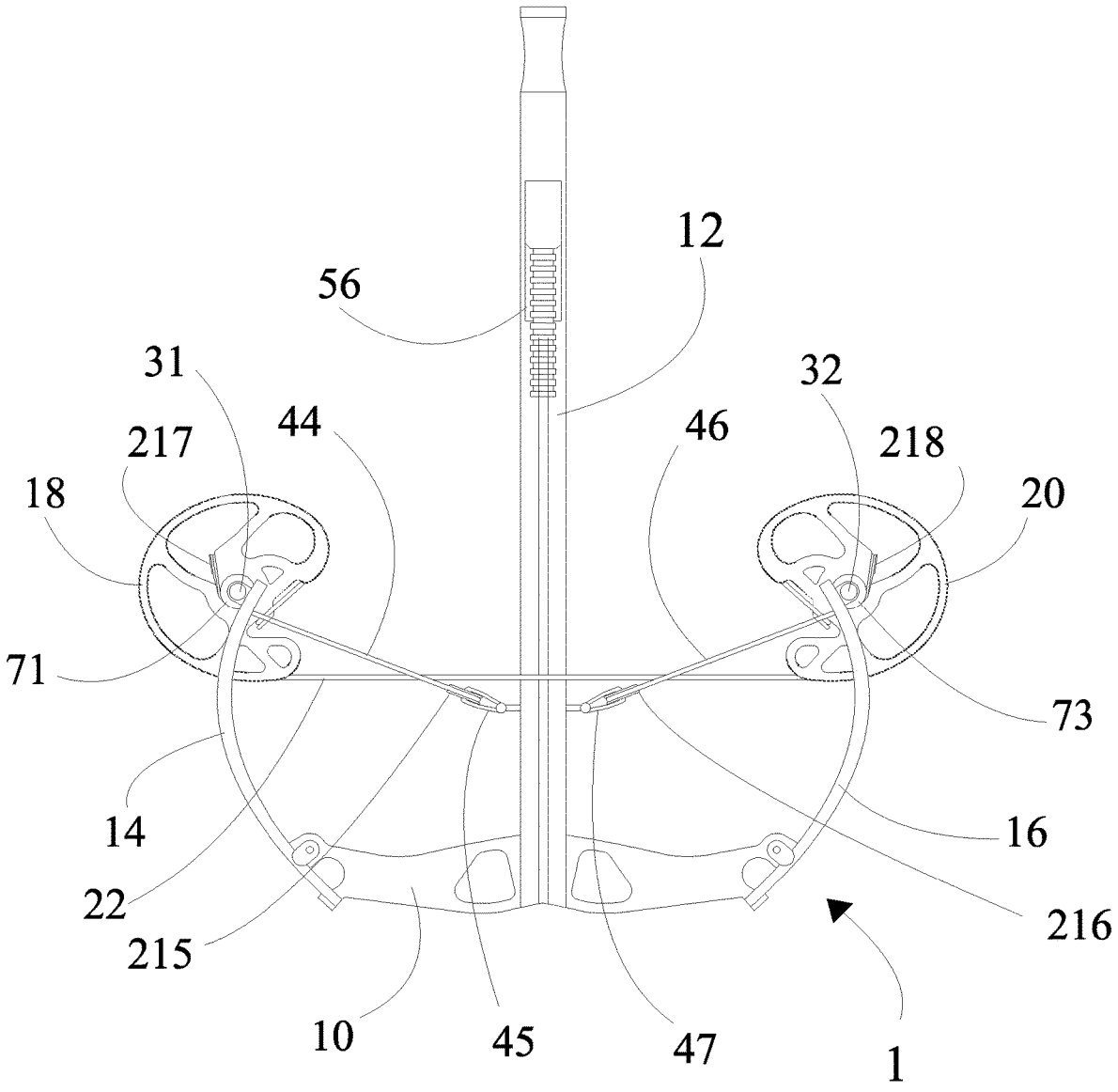
FIG. 3 is a top view of a conventional limb crossbow with inverted cams of the present invention in an at-rest position, having first and second cams; first and second cables; and a string, wherein opposing ends of the same cable are anchored to the same cam, and a mid-portion of the cables partially wrap a cable pulley of the present invention.
Figure 3A:
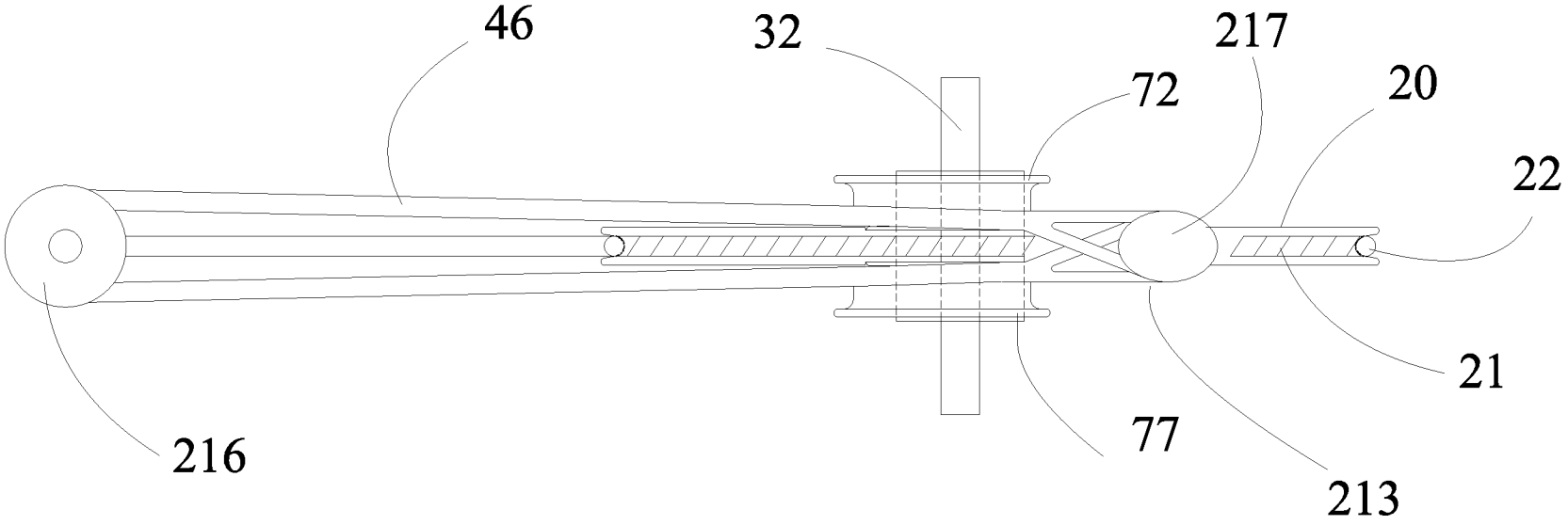
FIG. 3A is a side cut-away view of a second multi-piece cam with non-circular cable tracks of the present invention, having an upper and lower cable track that is at least twice as wide as the width of the cables; opposing ends of the second cable are anchored to the same post on the second cam, and a mid-portion of said second cable partially wraps a second cable pulley, a string and second cable are illustrated with the cam of the present invention.

With reference to FIG. 3, a similar crossbow is shown as relates to FIG. 2, however the first and second ends of the first cable 44 are anchored to a first cam single cable post 217 on a first cam 18, and the first and second ends of the second cable 46 are anchored to a second cam single cable post 218 on the second cam 20. FIG. 3A shows a partial cross section view of the crossbow of FIG. 3, wherein the first and second ends of cable 46 are anchored to a first cam 18 first cam single cable post 217.

Referring to FIGS. 4A-4J, the first cam 18 includes a first launch string track 19, a first cam upper cable track 40, a first cam launch string post 61, and a first cam lower cable track 41. A first end of the launch string 22 is retained by the first cam launch string post 61; a portion of the span of the launch string 22 at least partially wraps around the first cam 18 in the first cam launch string track 19; a portion of the span of the launch string 22 at least partially wraps the second cam 20 in the second cam launch string track 21, and a second end of the bowstring 22 is retained by the second cam launch string post 63.

The first end of the first cable 44 is coupled to the first cam first cable post 210; a segment of the first cable 44 partially engages the first cam upper cable track 40; the middle of the first cable 44 is retained by the first cable pulley 215 (not shown); a segment of the first cable 44 partially engages the first cam lower cable track 41; and the second end of the first cable 44 is coupled to the first cam second cable post 212. The first end of the second cable 46 is coupled to the second cam first cable post 211; a segment of the first cable 46 partially engages the second cam upper cable track 40; the middle of the first cable 46 is retained by the 216 (not shown); a segment of the second cable 46 partially engages the second cam lower cable track 41; and the second end of the second cable 46 is coupled to the second cam second cable post 213.

Figure 6A:
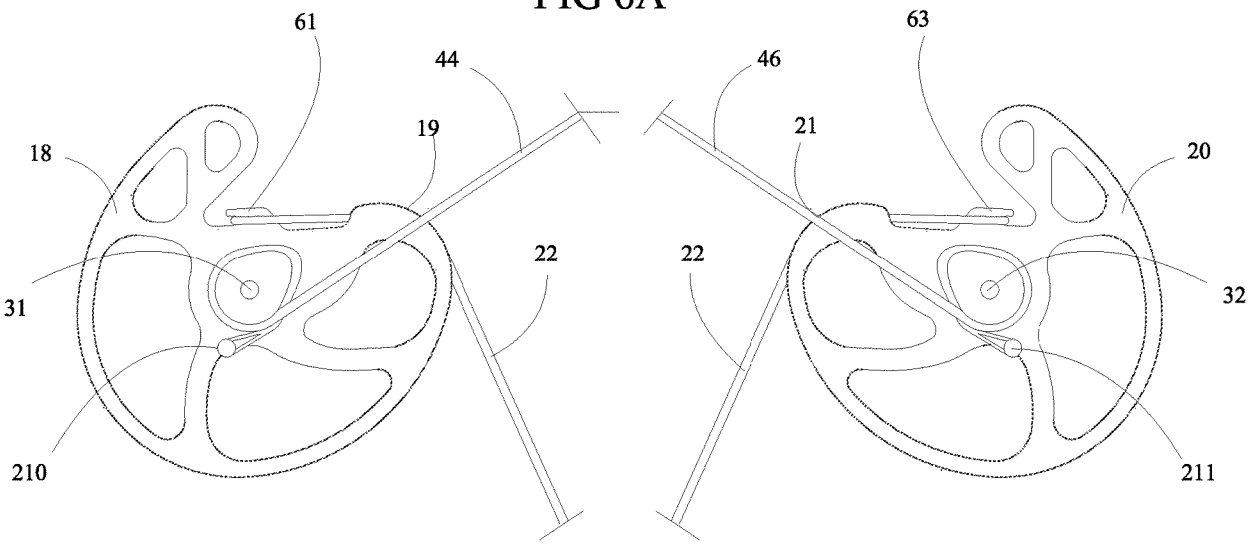
FIG. 6A is a top view of first and second multi-piece cams with non-circular cable tracks of the present invention; having an upper and lower cable track, modules have been removed for illustrative purposes; a string and cable are illustrated with the cam in a drawn position of the present invention.
Figure 6B:
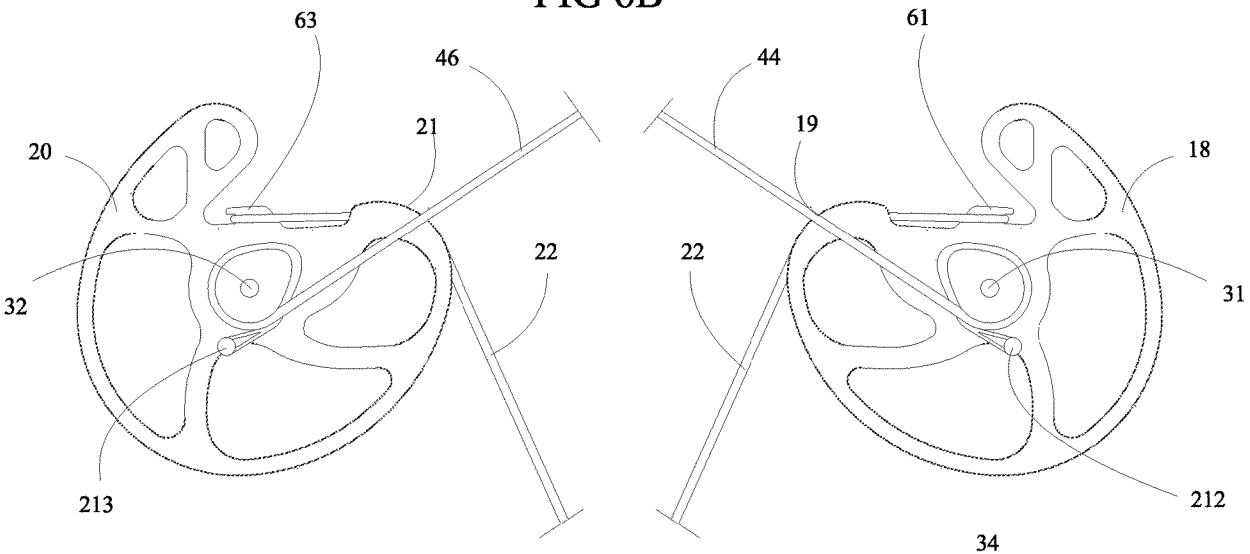
FIG. 6B is a bottom view of first and second multi-piece cams with non-circular cable tracks of the present invention, having an upper and lower cable, modules have been removed for illustrative purposes; a string and cable are illustrated with the cam in a drawn position of the present invention.

With reference to FIGS. 6A and 6B, when the launch string 22 is drawn from a rest position to a ready to fire position, the first cam 18 rotates in a first direction, and the second cam 20 rotates in a second direction. As the cams 18 and 20 rotate, the launch string 22 is unwound from the first and second launch string tracks 19 and 21. Simultaneously, the cables 44 and 46 wind into the first and second upper cable tracks 40 and 42 and the first and second lower cable tracks 41 and 43 of the first 18 and second 20 cams. When the launch string 22 has been drawn to the ready-to-fire position, it may be held in this the position by an operably releasable catch located in a housing 56. The first cable 44 is slidable relative to the first cable pulley 215 and the second cable 46 is slidable relative to the second cable pulley 216. The upper cable track 40, the lower cable track 41, the upper cable track 42 and the lower cable track 43 may be generally circular, or non-circular.

Figure 4A:
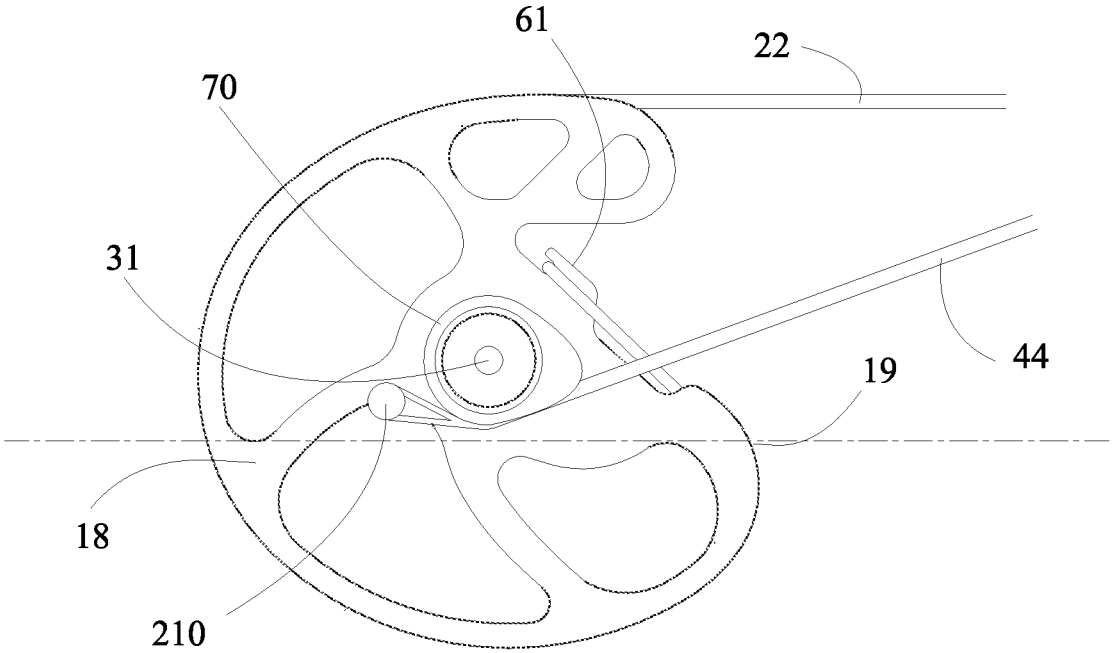
FIG. 4A is a top view of a first multi-piece cam with non-circular cable tracks of the present invention, a string and cable are illustrated with the cam of the present invention.
Figure 4B:
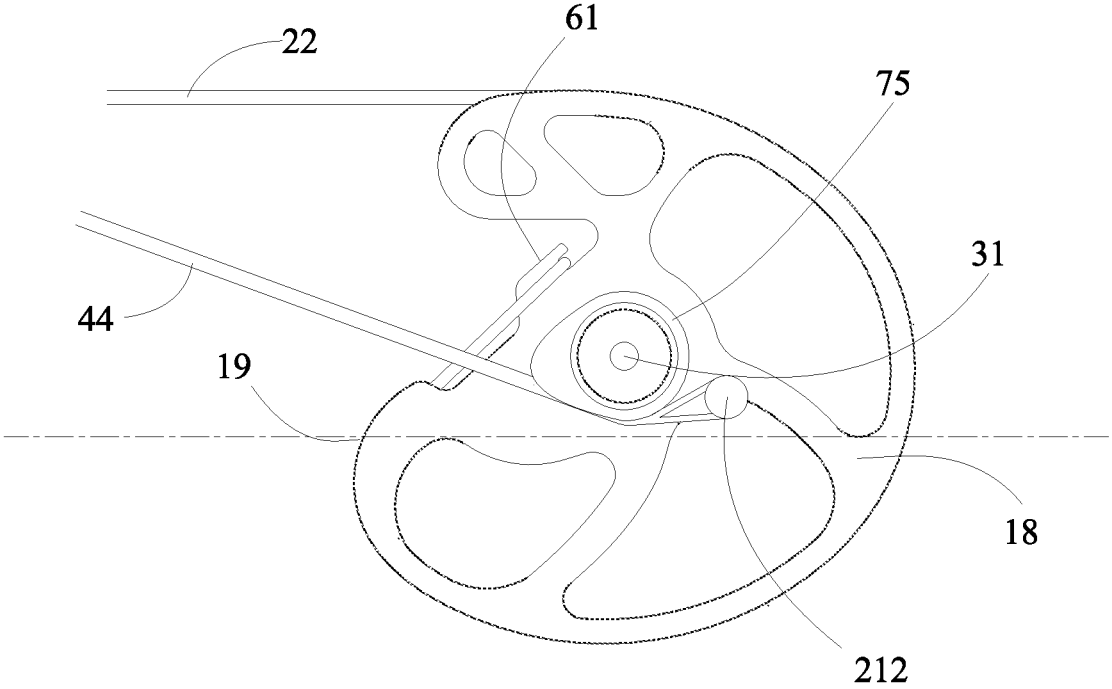
FIG. 4B is a bottom view of a first multi-piece cam with non-circular cable tracks of the present invention, a string and cable are illustrated with the cam of the present invention.
Figure 4E:
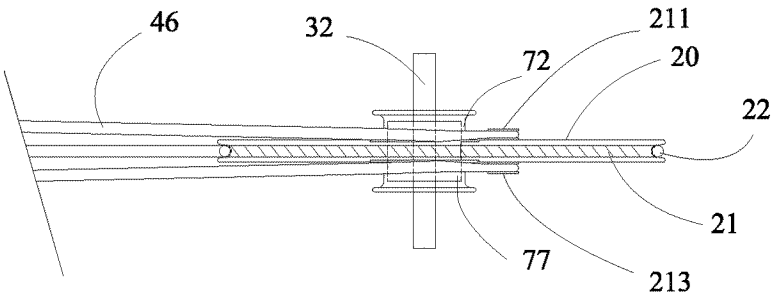
FIG. 4E is a side cut-away view of a second multi-piece cam with non-circular cable tracks of the present invention, having an upper and lower cable track, a string and cable are illustrated with the cam of the present invention.
Figure 4F:
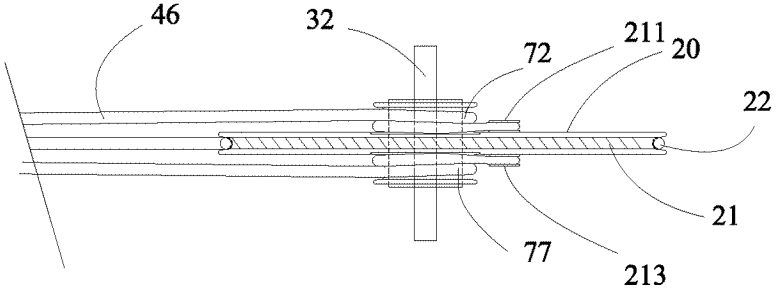
FIG. 4F is an exploded side view of a second multi-piece piece cam with non-circular cable tracks of the present invention having an upper and lower cable track, and having first and second mirror image modules of the present invention.
Figure 4C:
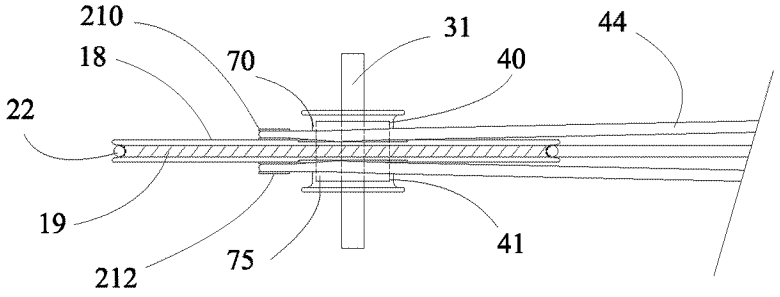
FIG. 4C is a side cut-away view of a first multi-piece cam with non-circular cable tracks of the present invention, having an upper and lower cable track, a string and cable are illustrated with the cam of the present invention.
Figure 4D:
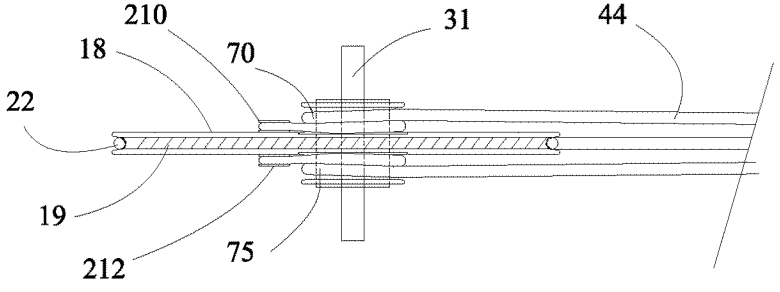
FIG. 4D is an exploded side view of a first multi-piece piece cam with non-circular cable tracks of the present invention having an upper and lower cable track, and having first and second mirror image modules of the present invention.
Figure 4I:
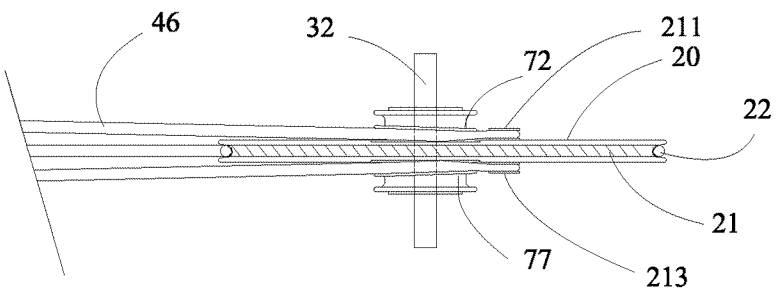
FIG. 4I is a side cut-away view of a second multi-piece cam with non-circular cable tracks of the present invention, having an upper and lower helical cable track, a string and cable are illustrated with the cam of the present invention.
Figure 4J:
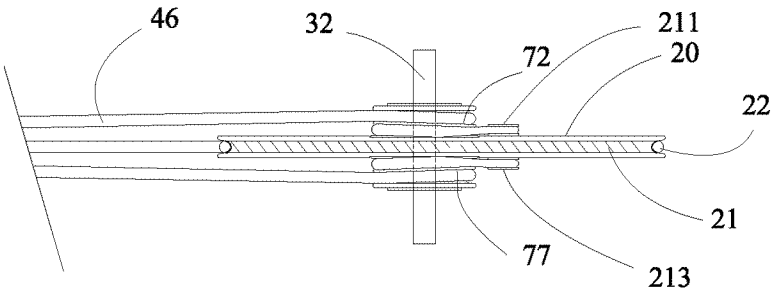
FIG. 4J is an exploded side view of a second multi-piece piece cam with non-circular cable tracks of the present invention having an upper and lower helical cable track, and having first and second mirror image modules of the present invention.
Figure 4G:
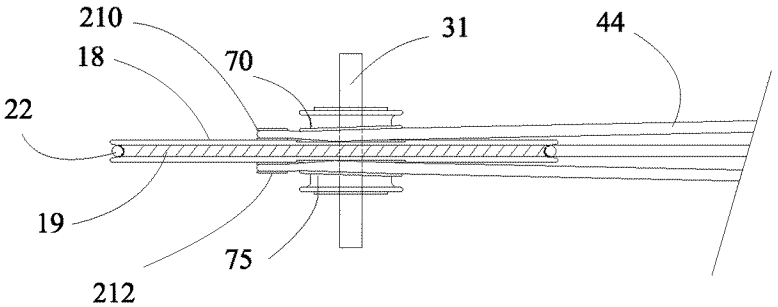
FIG. 4G is a side cut-away view of a first multi-piece cam with non-circular cable tracks of the present invention, having an upper and lower helical cable track, a string and cable are illustrated with the cam of the present invention.
Figure 4H:
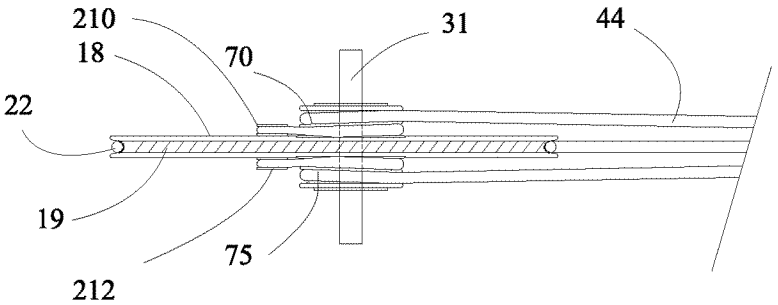
FIG. 4H is an exploded side view of a first multi-piece piece cam with non-circular cable tracks of the present invention having an upper and lower helical cable track, and having first and second mirror image modules of the present invention.

FIGS. 4A-4D and 5A-5D illustrate an embodiment of the first cam 18 of the current invention with string and cable(s), wherein the first cam 18 is constructed of a modular type construction. In this type of construction, the first and second side of the first cam 18 and the second cam 20 are mirror images of each other, and the first cam 18 is identical and interchangeable with the second cam 20. The first cam 18 includes a first module 70 and a second module 75. The first and second modules 70, 75 are mirror images of each other. The first and second modules 70, 75 are identical and are interchangeable with a first module 72 and a second module 77 of the second cam 20. Specifically, FIG. 4A is a top view of the first cam 18, FIG. 4B is a bottom view of the first cam 18, FIG. 4C is a cut-away view of the first cam 18 with the string 22 and the cable 44. The first module 70 and the second module 75 may be generally non-circular, or circular.

FIGS. 4G-4J illustrate an alternate embodiment of the first cam 18 of the current invention with string and cable(s), wherein the first cam 18 is constructed of a modular type construction. In this type of construction, the first and second side of the first cam 18 and the second cam 20 are mirror images of each other, and the first cam 18 is identical and interchangeable with the second cam 20. The first cam 18 includes a first helical module 70 and a second helical module 75. The first and second helical modules 70, 75 are mirror images of each other. The first and second helical modules 70, 75 are identical and are interchangeable with a first module 72 and a second module 77 of the second cam 20.

Figure 5A:
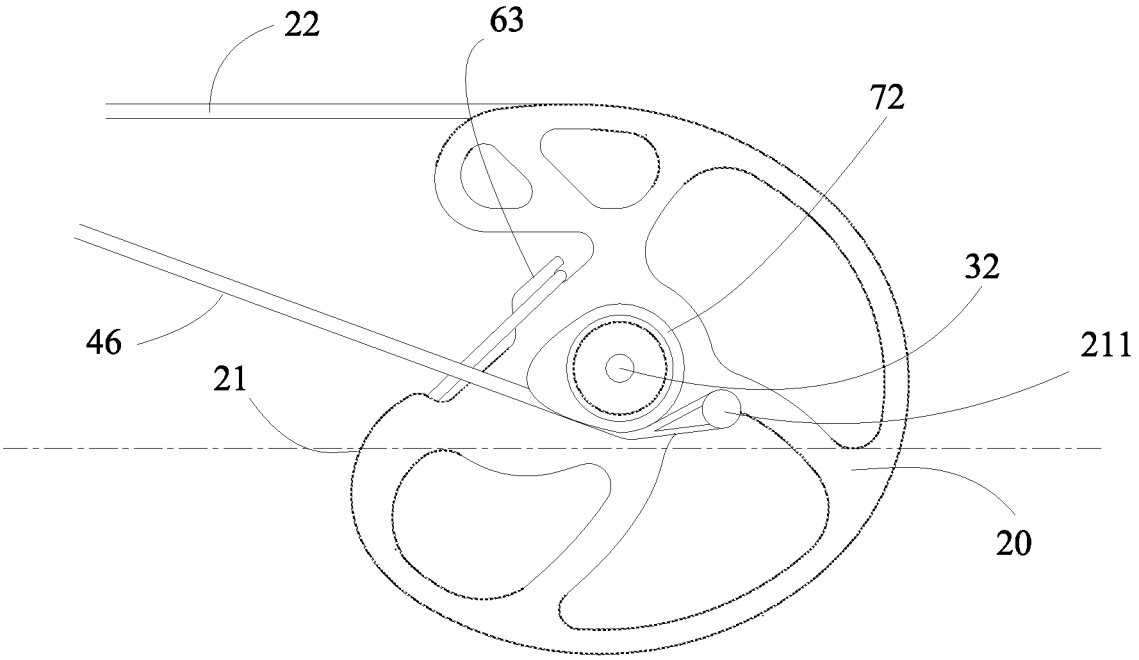
FIG. 5A is a top view of a second multi-piece cam with non-circular cable tracks of the present invention, a string and cable are illustrated with the cam of the present invention.
Figure 5B:
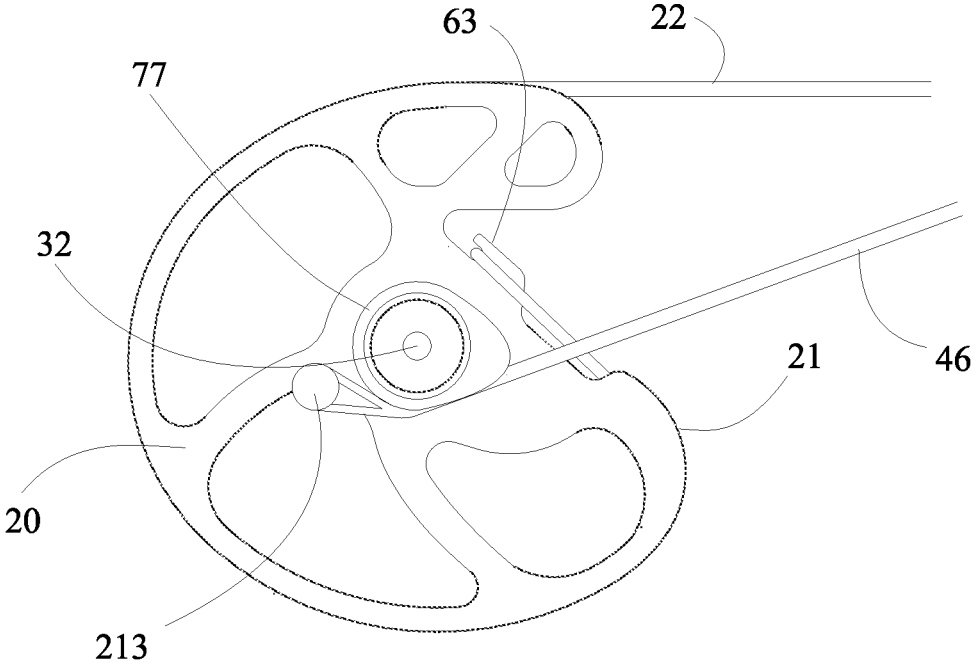
FIG. 5B is a bottom view of a second multi-piece cam with non-circular cable tracks of the present invention, a string and cable are illustrated with the cam of the present invention.
Figure 5C:
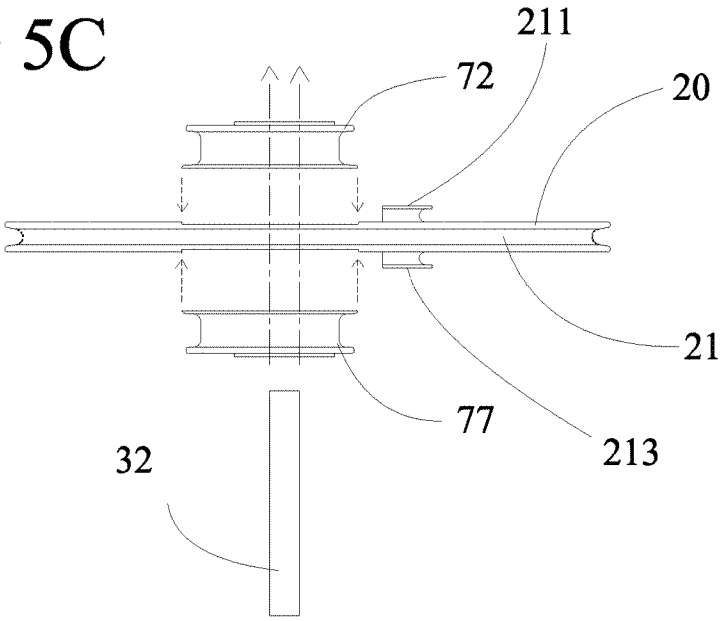
FIG. 5C is an exploded side view of a second multi-piece piece cam with non-circular cable tracks of the present invention having an upper and lower cable track that, and having a first and second mirror image modules of the present invention.
Figure 5D:
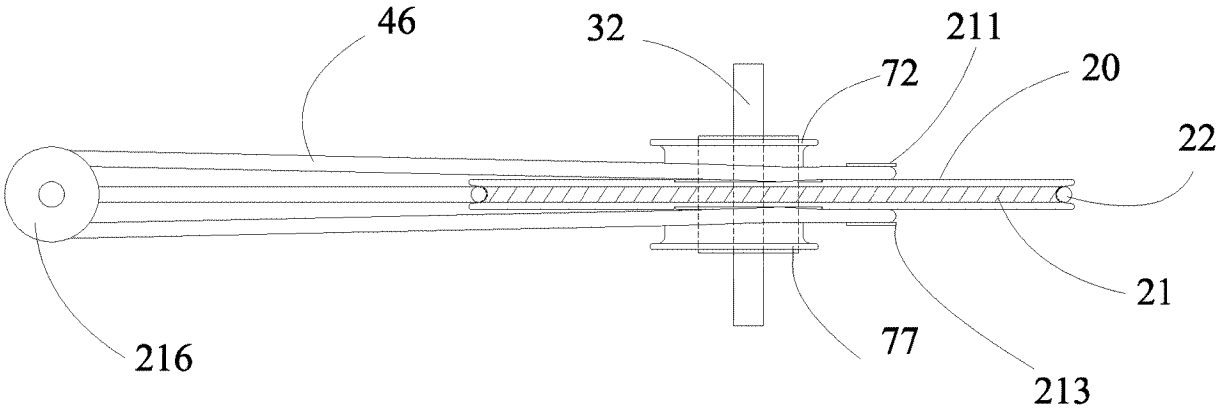
FIG. 5D is a side cut-away view of a second multi-piece cam with non-circular cable tracks of the present invention, having an upper and lower cable track; opposing ends of the second cable are anchored to the second cam, and a mid-segment of said second cable partially wraps a second cable pulley, a string and second cable are illustrated with the cam of the present invention.
Figure 5E:
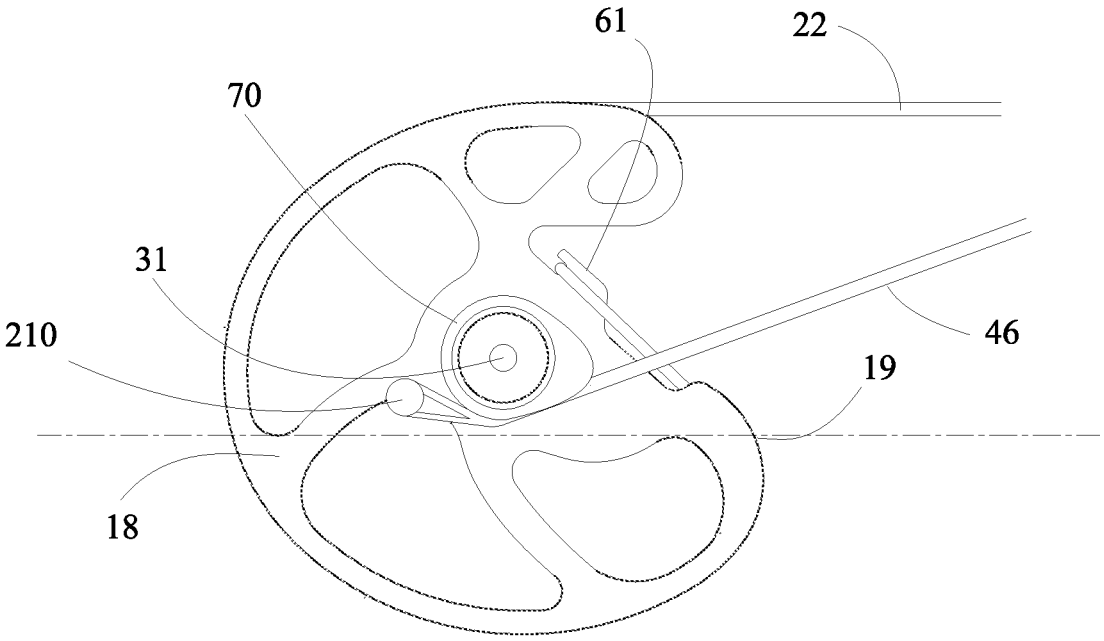
FIG. 5E is a top view of a first multi-piece cam with non-circular cable tracks of the present invention, a string and cable are illustrated with the cam of the present invention.
Figure 5F:
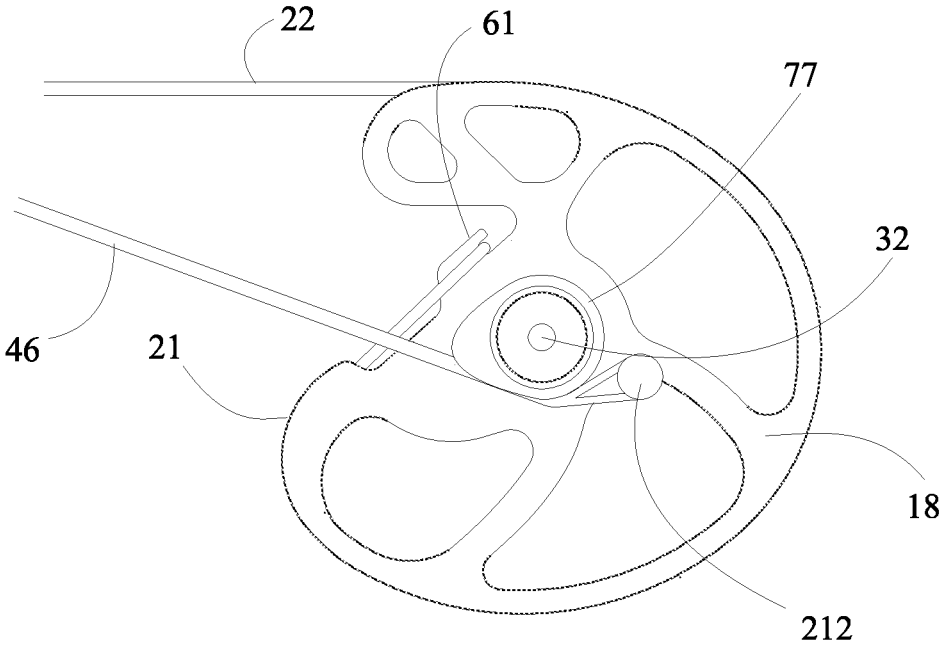
FIG. 5F is a bottom view of a first multi-piece cam with non-circular cable tracks of the present invention, a string and cable are illustrated with the cam of the present invention.
Figure 5G:
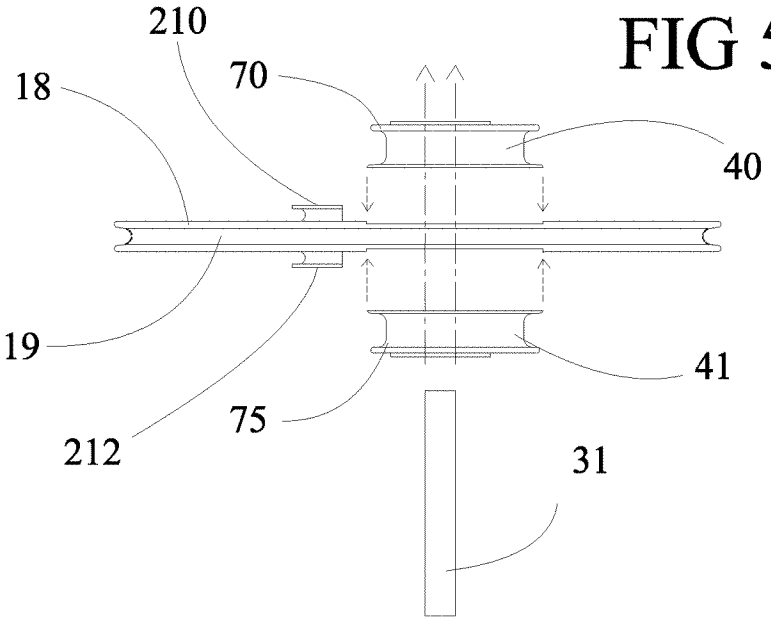
FIG. 5G is an exploded side view of a first multi-piece piece cam with non-circular cable tracks of the present invention having an upper and lower cable track, and having a first and second mirror image modules of the present invention.
Figure 5H:
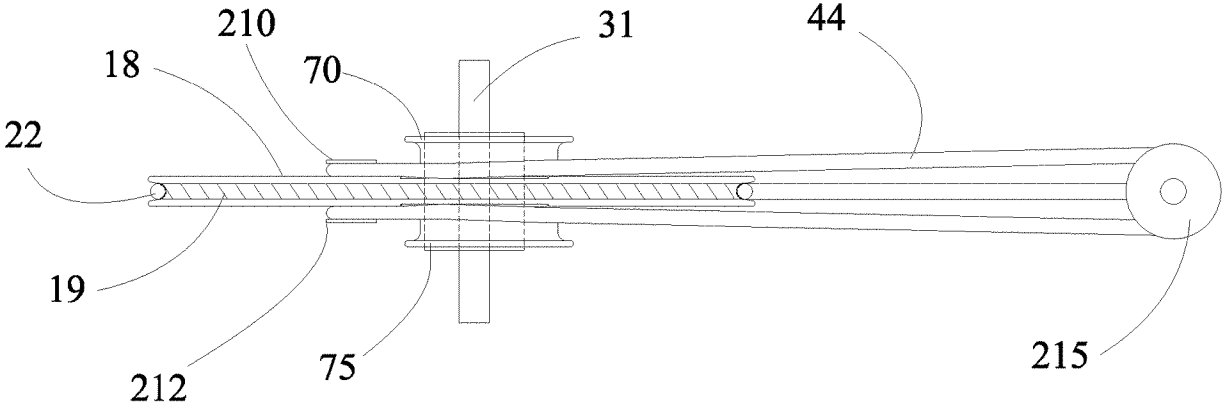
FIG. 5H is a side cut-away view of a first multi-piece cam with non-circular cable tracks of the present invention, having an upper and lower cable track; opposing ends of the first cable are anchored to the first cam, and a mid-segment of said first cable partially wraps a first cable pulley, a string and first cable are illustrated with the cam of the present invention.

FIGS. 5A-5D illustrate an embodiment of the second cam 20 of the current invention, with string and cable(s), wherein the second cam 20 is constructed of a modular type construction. In this type of construction, the first and second side of the second cam 20 and the first cam 18 are mirror images of each other, and the first cam 18 is identical and interchangeable with the second cam 20. The first module 72 and the second module 77 are mirror images of each other, and the first and second modules 70 and 75 are identical and interchangeable with the first and second modules 72 and 77. Specifically, FIG. 5A is a top view of the second cam 20, FIG. 5B is a bottom view of the second cam 20, FIG. 5C is a cut-away view of a second cam with the string 22 and the cable 46. The first module 72 and the second cable module 77 may be generally non-circular, or circular. FIG. 6A illustrates a top view of the first cam 18 and the second cam 20, in the drawn position. FIG. 6B illustrates a bottom view of the first cam 18 and the second cam 20, in the drawn position. FIGS. 6A and 6B are identical to each other and not just mirror images, as described previously in FIGS. 5A-5D. This feature allows for an easier method of manufacture and assembly.

A first end of the launch string 22 is anchored to the first cam string post 61; a segment of the launch string 22 partially wraps cam 18 in the string track 19; the string crosses the center of the riser 10; and partially wraps the second cam 20 in the string track 21; and the second end of the launch string 22 is anchored to the second cam string post 63.

With reference to FIGS. 4A-4D and 5A—5D, the mid-segment of the first and second cables 44, 46 "slidably" engage the first and second cable pulleys 215 and 216, which allows the first and second cables 44, 46 to self-center themselves relative to a first side and a second side of the first and second cams 18 and 20. The self-centering feature of the cables 44, 46 provides for automatic cable timing, which eliminates cam lean, and timing issues. As the launch string 22 is drawn, the launch string unwraps, or "pays out" from the first and second cams 18, 20. Simultaneously, the first and second cables 44, 46 wrap the respective first cable tracks 70, 75 and the second cable tracks 72, 77.

It is preferable that the second ends of the first and second cables 44 and 46 not be anchored to the same post. However the first and second cables 44, 46 will still function satisfactorily if anchored to the same post.

While the preferred embodiment of the invention has been illustrated and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A reverse style crossbow, comprising:

a first 3-track cam and a second 3-track cam, a launch string, a first cable coupled with said first 3-track cam and a second cable coupled with said second 3-track cam, each one of said first and second 3-track cams include a string track, a first cable track and a second cable track, said string track is located between said first and second cable tracks, wherein said launch string having a first segment retained in said string track of said first 3-track cam and a second segment retained said string track of said second 3-track cam, each of said first and second cables have a first end and a first end adjacent segment, a second end and a second end adjacent segment, and a mid-segment, said mid-segment of said first cable is retained by a first cable pulley, said mid-segment of said second cable is retained by a second cable pulley, said first and second cable pulleys cannot rotate, said first and second cable pulleys are not inset into a riser or rail of a crossbow, said first end adjacent segment of said first cable makes contact with only said first cable track on a first side of said first 3-track cam and said second end adjacent segment of said first cable makes contact with only said second cable track on a second side of said first 3-track cam, said first end adjacent segment of said second cable makes contact with only said first cable track on a first side of said second 3-track cam, and said second end adjacent segment of said second cable makes contact with only said second cable track on a second side of said second 3-track cam, said first and second ends of said first cable are anchored to said first 3-track cam, said first and second ends of said second cable are anchored to said second 3-track cam.

2. The reverse style crossbow of claim 1 wherein:
a first end of the launch string is anchored to said first 3-track cam and a second end of the launch string is anchored to said second 3-track cam.

3. The reverse style crossbow of claim 1 wherein:
said first cable is slidably engaged with said first cable pulley, said second cable is slidably engaged with said second cable pulley.

4. The reverse style crossbow of claim 1 wherein:
a distance between a center line of said first cable track and said string track is equal to a distance between a center line of said second cable track and said string track.

5. The reverse style crossbow of claim 1 wherein:
a first cable track module includes said first cable track, a second cable track module includes said second cable track.

6. A reverse style crossbow, comprising:
a first 3-track cam and a second 3-track cam, a launch string, a first cable coupled with said first cam and a second cable coupled with said second cam, each one of said first and second 3-track cams include a string track, a first cable track and a second cable track, said string track is located between said first and second cable tracks, wherein said launch string having a first segment retained in said string track of said first 3-track cam and a second segment retained said string track of said second 3-track cam, each of said first and second cables have a first end and a first end adjacent segment, a second end and a second end adjacent segment, and a mid-segment, said mid-segment of said first cable is retained by a first cable pulley, a mid-segment of said second cable is retained by a second cable pulley, said first and second cable pulleys cannot rotate, said first and second cable pulleys are not inset into a riser or rail of a crossbow, said first 3-track cam and said second 3-track cam are identical to each other, said first end adjacent segment of said first cable makes contact with only said first cable track on a first side of said first 3-track cam and said second end adjacent segment of said first cable makes contact with only said second cable track on a second side of said first 3-track cam, said first end adjacent segment of said second cable makes contact with only said first cable track on a first side of said second 3-track cam and said second end adjacent segment of said second cable makes contact with only said second cable track on a second side of said second 3-track cam, said first and second ends of said first cable are anchored to said first 3-track cam, said first and second ends of said second cable are anchored to said second 3-track cam.

7. The reverse style crossbow of claim 6 wherein:
a first end of the launch string is anchored to said first 3-track cam and a second end of the launch string is anchored to said second 3-track cam.

8. The reverse style crossbow of claim 6 wherein:
said first cable is slidably engaged with said first cable pulley, said second cable is slidably engaged with said second cable pulley.

9. The reverse style crossbow of claim 6 wherein:
a distance between a center line of said first cable track and said string track is equal to a distance between a center line of said second cable track and said string track.

10. The reverse style crossbow of claim 6 wherein:
a first cable track module includes said first cable track, a second cable track module includes said second cable track.

11. A reverse style crossbow, comprising:
a first 3-track cam and a second 3-track cam, a launch string, a first cable coupled with said first cam and a second cable coupled with said second cam, each one of said first and second 3-track cams include a string track, a first cable track and a second cable track, said string track is located between said first and second cable tracks, wherein said launch string having a first segment retained in said string track of said first 3-track cam and a second segment retained said string track of said second 3-track cam, each of said first and second cables have a first end and a first end adjacent segment, a second end and a second end adjacent segment, and a mid-segment, said mid-segment of said first cable is retained by a first cable pulley, a mid-segment of said second cable is retained by a second cable pulley, said first and second cable pulleys cannot rotate, said first and second cable pulleys are not inset into a riser or rail of a crossbow, a perimeter shape of said first cable track is the same as said second cable track, said first 3-track cam and said second 3-track cam are mirror images of each other, said first end adjacent segment of said first cable makes contact with only said first cable track on a first side of said first 3-track cam and said second end adjacent segment of said first cable makes contact with only said second cable track on a second side of said first 3-track cam, said first end adjacent segment of said second cable makes contact with only said first cable track on a first side of said second 3-track cam, and said second end adjacent segment of said second cable makes contact with only said second cable track on a second side of said second 3-track cam, said first and second ends of said first cable are anchored to said first 3-track cam, said first and second ends of said second cable are anchored to said second 3-track cam.

12. The reverse style crossbow of claim 11 wherein:
a first end of the launch string is anchored to said first 3-track cam and a second end of the launch string is anchored to said second 3-track cam.

13. The reverse style crossbow of claim 11 wherein:
said first cable is slidably engaged with said first cable pulley, said second cable is slidably engaged with said second cable pulley.

14. The reverse style crossbow of claim 11 wherein:
a distance between a center line of said first cable track and said string track is equal to a distance between a center line of said second cable track and said string track.

15. The reverse style crossbow of claim 11 wherein:
a first cable track module includes said first cable track, a second cable track module includes said second cable track.

* * * * *